US008997653B1

(12) United States Patent
Calvert

(10) Patent No.: US 8,997,653 B1
(45) Date of Patent: Apr. 7, 2015

(54) STROKE INDUCING BULLET

(71) Applicant: SIB Associates, Trustee for Stroke Inducing Bullet CRT Trust, Manassas, VA (US)

(72) Inventor: S. Mill Calvert, Manassas, VA (US)

(73) Assignee: SIB Associates, Manassas, VA (US), Trustee for Stroke inducing bullet CRT Trust ( * ) Notice: Subject to any disclaimer, the term of this patent is extended or adjusted under 35 U.S.C. 154(b) by 0 days.

(21) Appl. No.: 14/298,674

(22) Filed: Jun. 6, 2014

(51) Int. Cl.

| | |
|---|---|
| ***F42B 12/36*** | (2006.01) |
| ***F42B 12/46*** | (2006.01) |
| ***F42B 12/54*** | (2006.01) |
| ***F42B 7/10*** | (2006.01) |
| ***F42B 5/145*** | (2006.01) |
| ***F42B 30/02*** | (2006.01) |
| *F42B 7/04* | (2006.01) |

(52) U.S. Cl.
CPC ..... *F42B 5/145* (2013.01); *F42B 30/02* (2013.01); *F42B 7/046* (2013.01); *F42B 12/54* (2013.01); *F42B 7/10* (2013.01); *F42B 12/36* (2013.01); *F42B 12/46* (2013.01)

(58) Field of Classification Search
CPC ..... F42B 12/36; F42B 12/46; F42B 12/54; F42B 7/04; F42B 7/10; F42B 7/046; F42B 30/02; F42B 5/145
USPC ..... 102/439, 459, 501, 512, 513, 516, 517
See application file for complete search history.

(56) References Cited

U.S. PATENT DOCUMENTS

| | | | | |
|---|---|---|---|---|
| 3,003,420 | A | 10/1961 | Nosier | |
| 3,948,263 | A * | 4/1976 | Drake, Jr. et al. | 424/422 |
| 3,982,536 | A * | 9/1976 | Krogseng et al. | 424/422 |
| 4,136,616 | A | 1/1979 | Schirneker | |
| 5,400,716 | A | 3/1995 | Mayer | |
| 5,535,678 | A | 7/1996 | Brown | |
| 6,016,754 | A | 1/2000 | Enlow et al. | |
| 6,182,574 | B1 | 2/2001 | Giannoni | |
| 6,439,124 | B1 | 8/2002 | Enlow et al. | |
| 6,546,875 | B2 | 4/2003 | Vaughn et al. | |
| 7,654,202 | B2 * | 2/2010 | Romero | 102/517 |
| 8,088,406 | B2 * | 1/2012 | Potter et al. | 424/426 |
| 8,746,146 | B1 * | 6/2014 | Wiegand | 102/513 |
| 8,794,155 | B1 * | 8/2014 | Calvert | 102/512 |
| 8,875,658 | B2 * | 11/2014 | Anderson et al. | 119/51.01 |
| 2003/0159612 | A1 * | 8/2003 | Ziemack | 102/512 |
| 2005/0066850 | A1 * | 3/2005 | Leblanc et al. | 102/517 |
| 2007/0079721 | A1 * | 4/2007 | Webb | 102/506 |
| 2010/0224093 | A1 | 9/2010 | Wilhelm et al. | |

* cited by examiner

*Primary Examiner* — James S Bergin
(74) *Attorney, Agent, or Firm* — Louis Ventre, Jr.

(57) ABSTRACT

A bullet is formed with a hollow interior compartment which contains particles. The bullet side-wall surrounding the hollow interior compartment breaks after impact with the target to release the particles from the hollow interior compartment. Preferably, each particle in the hollow interior compartment has a core substance and a coating surrounding the core substance. The coating is designed to release the core substance after the bullet contacts a target. The core substance swells when in contact with blood, which may be time delayed in order to enter the blood stream.

3 Claims, 1 Drawing Sheet

STROKE INDUCING BULLET

TECHNICAL FIELD

In the field of ammunition and explosives, a bullet includes a particle that induces a stroke in the target.

BACKGROUND ART

The long history of warfare technology has evolved a great deal since the time of stone knives and clubs to the modern day drones and hell fire missiles. Years ago, military planners thought that the best way to win a military conflict was to quickly kill as many of the enemy as possible. Through many years of wars and conflicts, it was discovered that having a maximum killed in action count over a short period of time prolongs rather than shortens war and is not the best way to win a conflict.

When an enemy soldier is killed, he is of little added burden to the enemy. The enemy does not have to devote further resources, supplies or manpower to take care of that soldier. Military planners and strategists discovered that it is better to disable and wound an enemy soldier instead of instantly killing the soldier. A wounded soldier that is yelling and in agony has psychological effects on his fellow soldiers. They want to stop fighting and try to save or help him. They may leave secured positions of cover and move into the open to try to rescue him.

A great amount of resources, supplies and manpower must then be devoted to care for this wounded soldier, which can place great burdens on the enemy's capabilities to support war, such as manpower, medical resources, medics, transportation, hospital space, medicine and drugs, recovery or disability resources, etc. If military planners had their desire, they would rather have every enemy soldier become an invalid in bed that requires 24 hours per day care and resources. This burden can bankrupt and collapse an enemy's war fighting ability and defeat an enemy country in a shorter period of time.

An example of this military thinking can be seen by examining the lethal deadly stopping power of the 30-06 round used in World War II compared to the much lighter and smaller caliber bullet used in the Vietnam War, which was designed to wound and disable more of the enemy.

SUMMARY OF INVENTION

A bullet fireable from a cartridge for a firearm is formed with a hollow interior compartment which contains particles. The bullet side-wall surrounding the hollow interior compartment breaks after impact with the target to release the particles from the hollow interior compartment. Preferably, each particle in the hollow interior compartment has a core substance and a coating surrounding the core substance. The coating is designed to release the core substance after the bullet contacts a target. The core substance swells when in contact with blood, which may be time delayed in order to enter the blood stream and move into the bloodstream.

Technical Problem

When it comes to military strategy to disable the enemy, to make him a burden and liability, smaller caliber bullets previously used for this purpose have a limited capacity to accomplish this purpose. Should an enemy soldier be shot in the arm or leg with a smaller bullet, he may be a small burden to the enemy while he gets medical attention, but he will soon be patched up and back on the battlefield trying to ambush and kill our troops. If only there was a way to permanently disable an enemy soldier, so that soldier could not fight again, and also make the wounds a very large and permanent burden on the enemy country. This technology would increase the abhorrence of war and help to prevent and eliminate wars, or to bring them to a quick close.

Solution to Problem

The invention of the stroke inducing bullet is a new military technology that will inflict massive burden on the resources of an enemy, and hopefully prevent wars and convince countries to work out diplomatic agreements to solve issues instead. The stroke inducing bullet enables even the smallest of flesh wounds to create a massive stroke in the enemy soldier and turn him into a massive burden for the enemy.

The stroke inducing bullet works by having a bullet with a hollow interior compartment having a payload that is released after impact of the bullet with the target. The hollow interior compartment is filled with particulate matter that floats through a bloodstream and circulatory system to lodge in the brain and create a massive stroke. The bullet includes a frangible material that breaks apart as the bullet enters the enemy's body and releases the particulate matter.

The shattering of the bullet exposes the payload of floatable stroke inducing particles to the wound. Many of these particles will enter the bloodstream and begin their path toward the brain. Even the smallest of wounds that would have been no problem with a lightweight type AR bullet will now result in a massive stroke and massive burden to an enemy country.

The stroke inducing bullet technology fulfills the goal of military strategists to make every wounded enemy soldier a massive, lasting burden to the enemy country. Hopefully, this technology will convince political leaders to resolve their differences by peaceful means in place of having their country economically collapse under the weight of the burden of trying to permanently care for tens of thousands of stroke victims that used to be called soldiers.

Advantageous Effects of Invention

Discouraging war and quickly winning a war are advantageous effects of the stroke inducing bullet. One of the harsh medical conditions that people face is the sickness called stroke. A stroke occurs when a piece of matter floats through the bloodstream and causes disabling brain damage. A severe stroke can turn a person into a helpless invalid that can require round-the-clock care and expensive medical resources. A stroke is a very expensive burden that cannot be patched up like a flesh wound from a small caliber AR-15 round.

BRIEF DESCRIPTION OF DRAWINGS

The drawings illustrate preferred embodiments of the stroke inducing bullet according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
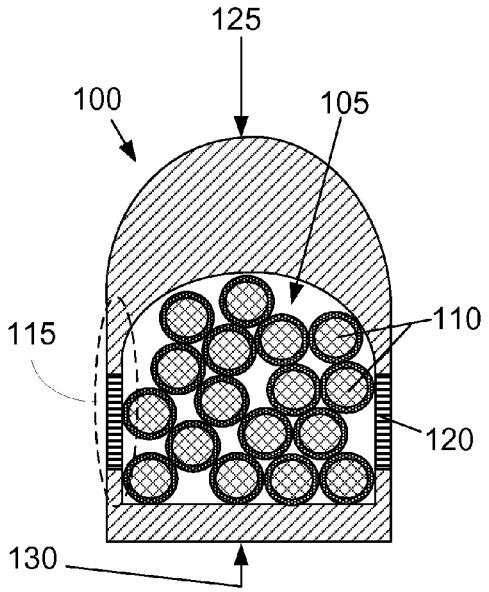
FIG. 1 is a sectional elevation view of a stroke inducing bullet according to the disclosure.

FIG. 1 illustrates a bullet (100) according to the disclosure. The bullet (100) defines a hollow interior compartment (105) and includes therein a plurality of particles (110). Preferably, each particle (200) in the plurality of particles (110) has a core substance (205) surrounded by a coating (210). The bullet (100) has a side-wall (115) shown in the dashed enclosure in FIG. 1 with a portion (120) of the side-wall (115) that breaks after impact with a target to release the plurality of particles (110) from the hollow interior compartment.

Figure 4:
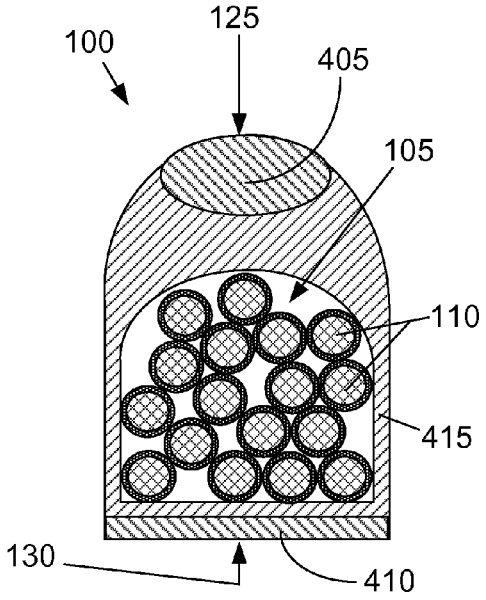
FIG. 4 is a sectional elevation view of a bullet with hardened leading and trailing ends.

The bullet (100) may be made with one or more materials suitable to the function of staying whole when shot and before it enters a target and breaking apart after it enters the target. Examples include: the bullet (100) made entirely of plastic or metal; the bullet (100) having a leading end (125) which strikes the target first made of a first hard material (405), shown in FIG. 4, such as lead or other metal and the remaining parts made of a frangible material such as plastic; the bullet (100) having a trailing end (130) made of second hard material (410) lead or other metal that remains whole while being propelled out of the weapon when the cartridge (300) is discharged and during transit to the target, and the remaining parts (415) made of a frangible material such as plastic; a bullet (100) having a frangible material in between a leading end (125) and a trailing end (130) made of such hard material; and a bullet (100) made of a single material that has thinned or weakened walls that break after impacting a target.

In application, the bullet (100), also referred to as a projectile, is within a cartridge (300) for a firearm. The cartridge (300) is for a firearm in that it is intended to be fired from a weapon. Thus, the cartridge (300) is configured to be discharged from within a firearm and propel the bullet (100) therefrom.

Figure 3:
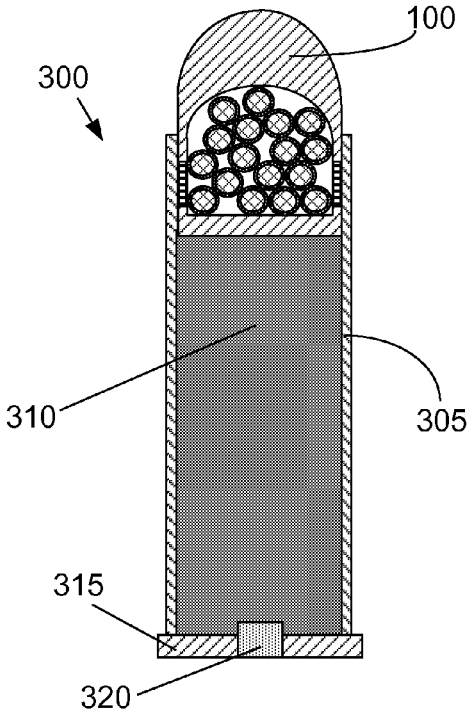
FIG. 3 is a sectional elevation view of the stroke inducing bullet within a cartridge for a firearm.

As for many cartridges for guns, there is preferably included in the cartridge (300), shown in FIG. 3, a propellant (310), a case (305) that holds the bullet (100), a rim (315) at the firing end of the cartridge, and a primer (320) that once struck by a firing pin of the weapon ignites the propellant (310) and sends the bullet (100) on its way, preferably intact until after the bullet (100) impacts the target. A rimless cartridge is also known and is included within the definition of a cartridge as used herein. The term cartridge is intended to broadly mean and include firearm ammunition wherein a projectile, to with the bullet (100), is propelled out of a weapon when the cartridge (300) is fired from the weapon.

The bullet (100) defines a hollow interior compartment (105). The hollow interior compartment (105) is preferably fully enclosed by, and within, the bullet (100). The bullet (100) comprises a side-wall (115) surrounding the hollow interior compartment (105), shown within the dashed enclosure in FIG. 1. The side-wall has a portion (120) that breaks after impact with the target to release the plurality of particles (110) from the hollow interior compartment (105). Examples of the portion (120) that breaks are: a thinned wall having less buckling strength than the bullet side-wall apart from the portion (120) so that the thinned wall disintegrates upon impact; a breakable plastic that is made to be a part of the bullet side-wall; and a serrated wall section that breaks at the serration upon impact.

Figure 2:
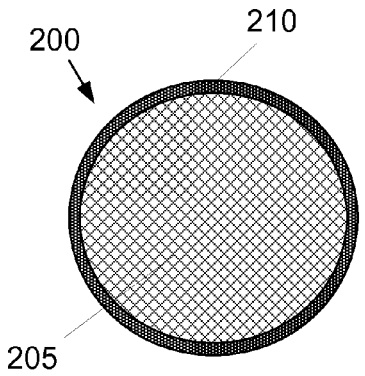
FIG. 2 is a sectional view of particle showing a coating over core substance.

The bullet (100) includes a plurality of particles (110) within the hollow interior compartment (105). At least one, and preferably each, particle (200), shown in FIG. 2, in the plurality of particles has a coating (210) surrounding a core substance (205). The particles (110) preferably have a specific gravity about equal to blood so that it floats or can be easily carried by the blood. Since blood has a specific gravity between about 1.02 to 1.06 at temperatures ranging from 4 degrees Centigrade to 37 degrees Centigrade, the particles are preferably fabricated to have a specific gravity at or below this same range, that is, up to about 1.06.

The coating (210) is designed and configured to release the core substance (205) after contact with a target. Preferably, the coating (210) seals the core substance (205) within and is made to release the core substance (205) once the coating (210) is in contact with blood, other bodily fluid, or heat. Thus, the coating (210) may be configured to release the core substance (205) after contact with the target and when the coating (210) is wetted with blood. Alternatively, the coating (210) may be configured to release the core substance (205) after contact with the target and when the particle (200) is warmed within the target.

The coating (210) may employ time release technology (also known as sustained-release, sustained-action, extended-release, timed-release, controlled-release, modified release, or continuous-release). Time release technology is a mechanism used in pill tablets or capsules to dissolve a drug over time in order to be released slower and steadier into the bloodstream while having the advantage of being taken at less frequent intervals than immediate-release formulations of the same drug.

In an alternative embodiment, the coating (210) defines channels or holes through the coating to permit in-seepage of fluid after the bullet (100) is fired from the gun. The fluid that seeps into the particle causes the core substance (205) to expand and break the coating (210) releasing the core substance (205), so for example, that the core substance (205) may enter a target's blood stream.

The porosity of the particles may be adjusted by freeze-drying, or any other process known in the art. Adjusting the porosity of the particles may also adjust the rate at which the core substance (205) expands and/or absorbs fluid. For example, the porosity of the particles may be adjusted so the rate at which the particles absorb blood or other bodily fluids is extremely rapid, e.g., having a time to substantial completion of absorption of less than about one second to about ninety seconds.

In one embodiment, the particle (200) may be considered a capsule in that there is a solid shell surrounding a core-forming space available to temporarily entrap the core substance (205). Encapsulation can produce complex dissolution profiles, for example by coating an active pharmaceutical ingredient around the core substance (205), and layering it with insoluble substances to form a sphere, just about any shell or coating (210) dissolution rate can be attained.

The core substance (205) is a material that expands or swells when in contact with a fluid, such as blood. An exemplary core substance is hydrogel, also known as aquagel. Hydrogel is a material that absorbs solvents (such as water), undergoes rapid swelling without discernible dissolution, and maintains three-dimensional networks capable of reversible deformation. Non-degradable hydrogels have been made from poly(vinyl pyrrolidone) and methacrylate and have been fashioned into fallopian tubal occluding devices that swell and occlude the lumen of the tube. Hydrogels can be water-swellable and/or thermally expanded. One example of a thermally expandable hydrogel is a freeze-dried hydrogel, usually called xerogel. Xerogel is a generic term for a solid formed from a gel by drying with unhindered shrinkage. Xerogels usually retain high porosity (15-50%) and enormous surface area (150-900 m2/g), along with very small pore size (1-10 nm). Some xerogels are known to rapidly swell when exposed to an aqueous environment, and may swell to multiple times its initial mass and initial volume.

In an alternative embodiment, the core substance (205) is a gel or a microgel, which is composed of particles made of a polymer colloid that expand (swell) in a solvent or when the particle charge increases. Particles may have peptide actuators that are recognized and cleaved by enzymes, thereby triggering a departure from the charge balance in the particles and activating the swelling. Enzyme-responsive microgels are known to operate locally, under aqueous conditions. They employ inflatable members that partially or completely occlude the vessel and mold the moldable material during polymerization.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the weapons industry.

What is claimed is:

1. A bullet within a cartridge, the cartridge configured to be discharged from a firearm, the bullet formed with a hollow interior compartment, the bullet comprising:

a plurality of particles within the hollow interior compartment, wherein at least one particle in said plurality of particles comprises:

a core substance;

a coating surrounding the core substance, the coating configured to release the core substance after contact with a target; and the core substance swelling when in contact with a fluid; and a side-wall surrounding the hollow interior compartment, the side-wall comprising a portion that breaks after impact with the target to release the plurality of particles from the hollow interior compartment.

2. The bullet of claim 1, wherein the coating is configured to release the core substance after contact with the target and when the coating is wetted with blood.

3. The bullet of claim 1, wherein the coating is configured to release the core substance after contact with the target and when the particle is warmed within the target.

* * * * *